US010479547B2

(12) United States Patent
Sumitomo

(10) Patent No.: US 10,479,547 B2
(45) Date of Patent: Nov. 19, 2019

(54) PACKING

(71) Applicant: KYOCERA Document Solutions Inc., Osaka (JP)

(72) Inventor: Seiji Sumitomo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/605,131

(22) Filed: May 25, 2017

(65) Prior Publication Data

US 2017/0341802 A1 Nov. 30, 2017

(30) Foreign Application Priority Data

May 31, 2016 (JP) ..... 2016-108423

(51) Int. Cl.
*B65D 43/22* (2006.01)
*B65D 17/28* (2006.01)
(Continued)

(52) U.S. Cl.
CPC ..... *B65D 5/0236* (2013.01); *B65D 5/0254* (2013.01); *B65D 5/541* (2013.01); *B65D 5/6611* (2013.01); *B65D 2101/00* (2013.01)

(58) Field of Classification Search
CPC .... B65D 5/0236; B65D 5/0254; B65D 5/541; B65D 5/6611; B65D 2101/00
(Continued)

(56) References Cited

U.S. PATENT DOCUMENTS 1,184,715 A * 5/1916 Bloomer ..... B65D 5/0254 229/102
6,209,785 B1 * 4/2001 Ben-Haim ..... B65D 5/541 206/542

(Continued)

FOREIGN PATENT DOCUMENTS

CN 102198874 A 9/2011
CN 202320965 U 7/2012

(Continued)

OTHER PUBLICATIONS

An Office Action issued by the Chinese Patent Office (SIPO) dated Aug. 28, 2018, which corresponds to Chinese Patent Application No. 201710381704.1 and is related to U.S. Appl. No. 15/605,131; with English language translation.

(Continued)

*Primary Examiner* — J. Gregory Pickett
*Assistant Examiner* — Niki M Eloshway
(74) *Attorney, Agent, or Firm* — Studebaker & Brackett PC

(57) ABSTRACT

Packing includes a body section, a cover section, and a label. The body section has a first opening. The cover section closes the first opening. The label is adhered so as to span across the cover section and the body section. At least one of the body section and the cover section has a cut section. The cut section is located at a position where the label is adhered. The cut section of the packing is damaged when the label is removed. As a result, the label has a roughened surface in a situation in which the label is re-adhered. The roughened surface allows visual confirmation of an evidence of tampering with the packing. Thus, the packing is difficult to reseal, restricting tampering with the packing.

6 Claims, 5 Drawing Sheets

(51) Int. Cl.

| | |
|---|---|
| ***B65D 5/02*** | (2006.01) |
| ***B65D 5/54*** | (2006.01) |
| ***B65D 5/66*** | (2006.01) |
| *B65D 51/20* | (2006.01) |

(58) Field of Classification Search
USPC ..... 220/214, 270, 258.1; 229/240
See application file for complete search history.

(56) References Cited

U.S. PATENT DOCUMENTS

| | | | | |
|---|---|---|---|---|
| 2007/0063008 | A1* | 3/2007 | El-Afandi | B65D 5/0236 229/125.39 |
| 2008/0083822 | A1* | 4/2008 | Benes | B65D 5/0236 229/185.1 |
| 2011/0233205 | A1 | 9/2011 | Suzuki et al. | |
| 2014/0217163 | A1* | 8/2014 | Marshall | B65D 5/0236 229/208 |
| 2016/0180747 | A1* | 6/2016 | Pietarinen | G09F 3/0292 206/438 |
| 2016/0214758 | A1* | 7/2016 | Yamamura | B65D 5/6608 |
| 2017/0121052 | A1* | 5/2017 | Morimoto | B65D 5/54 |
| 2018/0170610 | A1* | 6/2018 | Buss | B65D 5/6661 |

FOREIGN PATENT DOCUMENTS

| | | | |
|---|---|---|---|
| CN | 205098606 | U | 3/2016 |
| JP | H08-254955 | A | 10/1996 |
| JP | 2013-112393 | A | 6/2013 |

OTHER PUBLICATIONS

An Office Action mailed by the Japanese Patent Office dated Jan. 8, 2019, which corresponds to Japanese Patent Application No. 2016-108423 and is related to U.S. Appl. No. 15/605,131; with English translation.

* cited by examiner

PACKING

INCORPORATION BY REFERENCE

The present application claims priority under 35 U.S.C. § 119 to Japanese Patent Application No. 2016-108423, filed on May 31, 2016. The contents of this application are incorporated herein by reference in their entirety.

BACKGROUND

The present disclosure relates to packing.

A tamper-proof label is adhered to a container so as to span across a body and a cover of the container. The label is adhered to the container through an adhesive layer thereof, which is located between the container and the label. The label is removed when the container is opened. The label is damaged when it is removed from the container. Utilizing the above, the tamper-proof label prevents tampering with the container to prevent for example replacement of a content of the container body.

SUMMARY

Packing according to an aspect of the present disclosure includes a body section, a cover section, and a label. The body section has a first opening. The cover section closes the first opening. The label is adhered so as to span across the cover section and the body section with the first opening closed by the cover section. At least one of the body section and the cover section has a cut section. The cut section is located at a position where the label is adhered.

DETAILED DESCRIPTION

Figure 1:
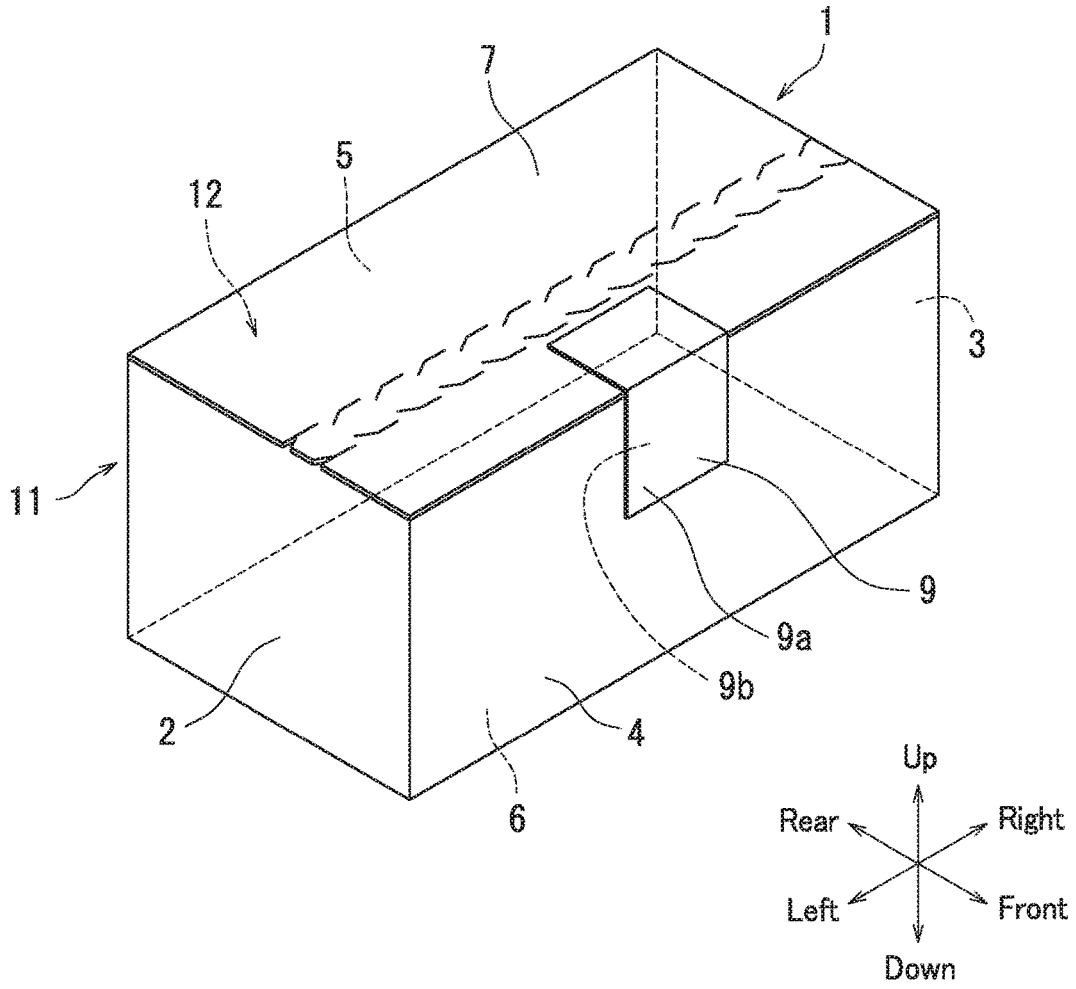
FIG. 1 is a perspective view illustrating packing according to an embodiment of the present disclosure.

The following describes embodiments of the present disclosure with reference to the drawings. However, the present disclosure is not limited to the embodiments. Note that in the drawings, elements that are the same or substantially equivalent are labelled using the same reference signs and description thereof is not repeated.

FIG. 1 is a perspective view illustrating packing 1 according to an embodiment of the present disclosure. As illustrated in FIG. 1, the packing 1 is erected into the shape of a rectangular box. The packing 1 includes a side plate section 2, a side plate section 3, a front plate section 4, a rear plate section 5, a bottom plate section 6, a cover section 7, and a label 9. The side plate sections 2 and 3, the front plate section 4, the rear plate section 5, the bottom plate section 6, and the cover section 7 are for example made of paper such as cardboard. The packing 1 is used for packing an article. The packed article is for example a replacement component such as a toner cartridge.

A front-rear direction in FIG. 1 is defined on the assumption that an outer side of the front plate section 4 of the packing 1 faces forward. A left-right direction is defined on the assumption that a left side of the packing 1 is to the left of the front plate section 4 viewed from the front. An up-down direction is defined as a direction perpendicular to the front-rear direction and the left-right direction.

The packing 1 is erected into the shape of a rectangular box. The side plate sections 2 and 3, the front plate section 4, the rear plate section 5, and the bottom plate section 6 form a body section 11. The body section 11 has an opening (first opening) 12, The body section 11 according to the present embodiment has the opening 12 at a top face thereof. The cover section 7 closes the opening 12. The rear plate section 5 and the front plate section 4 are located opposite to each other in the box-shaped packing 1. Likewise, the bottom plate section 6 and the cover section 7 are located opposite to each other. Furthermore, the side plate section 2 and the side plate section 3 are located opposite to each other.

The label 9 is adhered so as to span across the cover section 7 and the body section 11 with the opening 12 closed by the cover section 7. The label 9 according to the present embodiment is in the shape of a rectangular sheet. The label 9 has an outer part 9*a* and a back part 9*b*. The back part 9*b* is on an opposite side to the outer part 9*a*. The outer part 9*a* is for example made from a resin such as polyethylene and PET. The back pail 9*b* is for example formed from an adhesive such as a glue.

Figure 2:
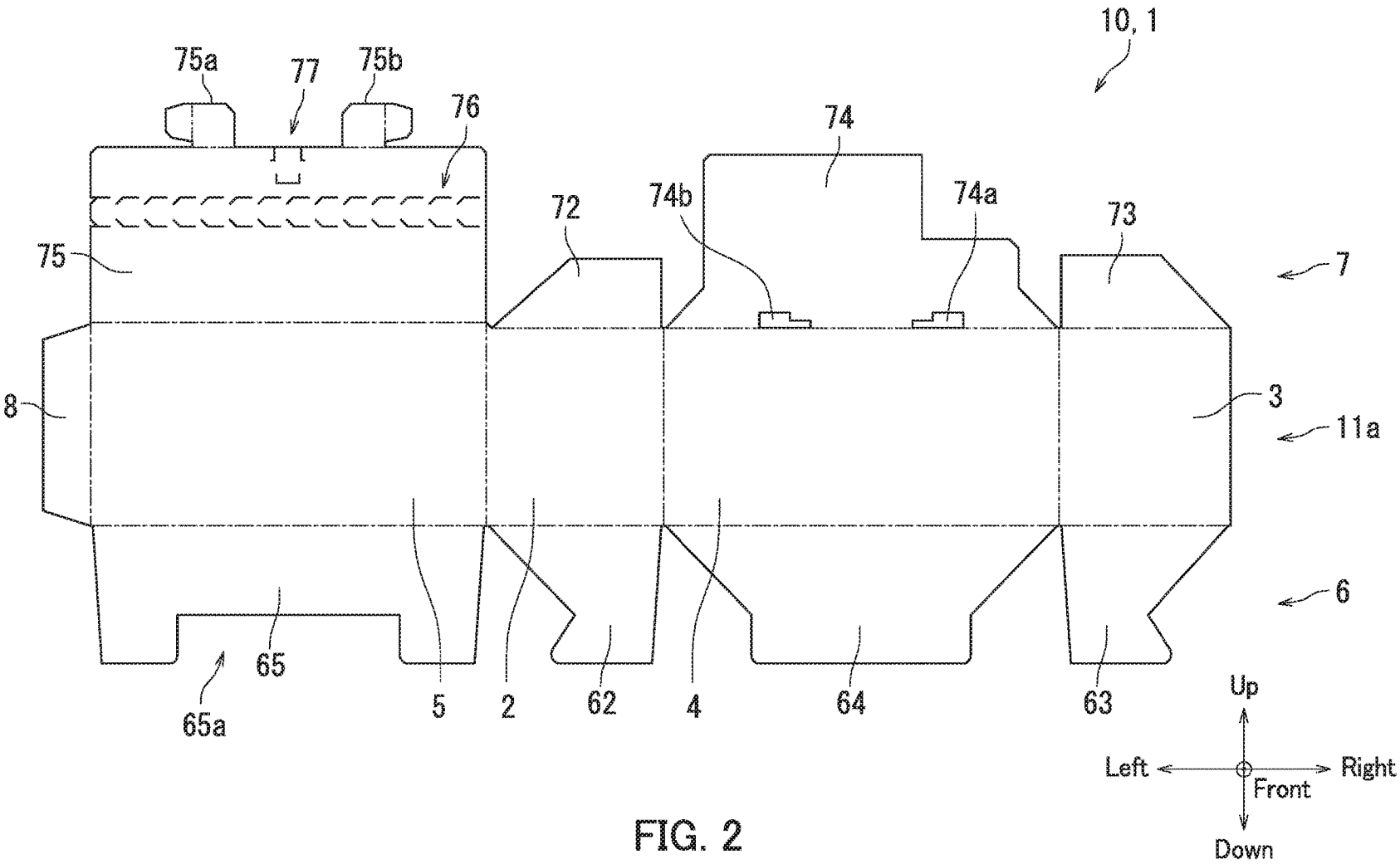
FIG. 2 is a diagram illustrating a sheet, which is the packing illustrated in FIG. 1 in an unfolded state.

FIG. 2 is a diagram illustrating a sheet 10, which is the packing 1 in FIG. 1 in an unfolded state. More specifically, FIG. 2 illustrating the sheet 10 shows an outer surface of the packing 1. A left-right direction and an up-down direction in FIG. 2 are defined with respect to the front plate section 4. More specifically, the left-right direction in FIG. 2 is defined on the assumption that a left side of the sheet 10 is to the left of the front plate section 4 viewed from the front. The up-down direction in FIG. 2 is defined as a direction perpendicular to the left-right direction. Note that the label 9, which is illustrated in FIG. 1, is not shown in FIG. 2.

The packing 1 is erected by folding the sheet 10 at dot-dash-lines illustrated in FIG. 2. Furthermore, the packing 1 is erected by bonding portions of the sheet 10 together through an adhesive layer. The adhesive layer is for example formed from an adhesive such as a glue. The sheet 10 for example has a thickness of 5 mm.

The dot-dash-lines extending in the left-right direction divide the sheet 10 into a side section 11*a*, the bottom plate section 6, and the cover section 7. The side section 11*a* includes the side plate sections 2 and 3, the front plate section 4, the rear plate section 5, and an adhesion section 8. The adhesion section 8, the rear plate section 5, the side plate section 2, the front plate section 4, and the side plate section 3 are continuous in the stated order from a left edge to a right edge of the side section 11*a*.

The adhesion section 8 has a specific width. The adhesion section 8 has an adhesive layer formed on an outer surface thereof. The adhesive layer is for example formed by a lamination process such as an application process. The adhesion section 8 is bonded to an inner surface of the side plate section 3 through the adhesive layer when the packing 1 is erected. Alternatively, the adhesive layer may be formed on an inner surface of the adhesion section 8. In a configuration in which the adhesive layer is formed on the inner surface, the adhesion section 8 is bonded to an outer surface of the side plate section 3 through the adhesive layer.

The bottom plate section 6 includes a rear plate bottom section 65, a side plate bottom section 62, a front plate bottom section 64, and a side plate bottom section 63. The rear plate bottom section 65 is downwardly continued from the rear plate section 5. The side plate bottom section 62 is downwardly continued from the side plate section 2. The front plate bottom section 64 is downwardly continued from the front plate section 4. The side plate bottom section 63 is downwardly continued from the side plate section 3.

For assembling the bottom plate section 6, the side plate bottom section 62 and the side plate bottom section 63 are first folded, and subsequently the rear plate bottom section 65 is folded. Next, the front plate bottom section 64 is folded. The rear plate bottom section 65 has a recess 65*a* in a distal section thereof. A distal section of the front plate bottom section 64 is inserted through the recess 65*a* of the rear plate bottom section 65 to a location inside the rear plate bottom section 65 when the front plate bottom section 64 is folded. Thus, the side plate bottom section 62, the side plate bottom section 63, the front plate bottom section 64, and the rear plate bottom section 65 form the bottom plate section 6. Alternatively, the bottom plate section 6 may have a configuration in which the distal section of the front plate bottom section 64 has an adhesive layer formed on an outer surface thereof, and the distal section of the front plate bottom section 64 is bonded to an inner surface of the rear plate bottom section 65.

The cover section 7 includes a rear plate cover section 75, a side plate cover section 72, a front plate cover section 74, and a side plate cover section 73. The rear plate cover section 75 is upwardly continued from the rear plate section 5. The side plate cover section 72 is upwardly continued from the side plate section 2. The front plate cover section 74 is upwardly continued from the front plate section 4. The side plate cover section 73 is upwardly continued from the side plate section 3.

The rear plate cover section 75 has engagement sections 75*a* and 75*b*. The engagement sections 75*a* and 75*b* protrude from an edge of the rear plate cover section 75. The engagement section 75*a* is in the shape of the letter L having a distal section protruding outward (leftward). The engagement section 75*b* is in the shape of the letter L having a distal section protruding outward (rightward). The front plate cover section 74 has openings (second opening) 74*a* and 74*b*. The openings 74*a* and 74*b* are formed in a proximal section of the front plate cover section 74. The engagement section 75*a* is inserted through the opening 74*a*. The engagement section 75*b* is inserted through the opening 74*b*.

For assembling the cover section 7, the side plate cover sections 72 and 73 are first folded, and subsequently the front plate cover section 74 is folded. Next, the rear plate cover section 75 is folded. The engagement sections 75*a* and 75*b* are respectively inserted through the openings 74*a* and 74*b* as the rear plate cover section 75 is folded. For inserting the engagement sections 75*a* and 75*b* through the openings 74*a* and 74*b*, respectively, the distal sections of the engagement section 75*a* and 75*b* are folded. Inside the front plate cover section 74, the distal sections of the engagement sections 75*a* and 75*b* unfold, and thus come in engagement with an inner surface of the front plate cover section 74. Alternatively, the cover section 7 may have a configuration in which the proximal section of the front plate cover section 74 has an adhesive layer formed on an outer surface thereof, and the proximal section of the front plate cover section 74 is bonded to the distal section of the rear plate cover section 75.

Figure 3:
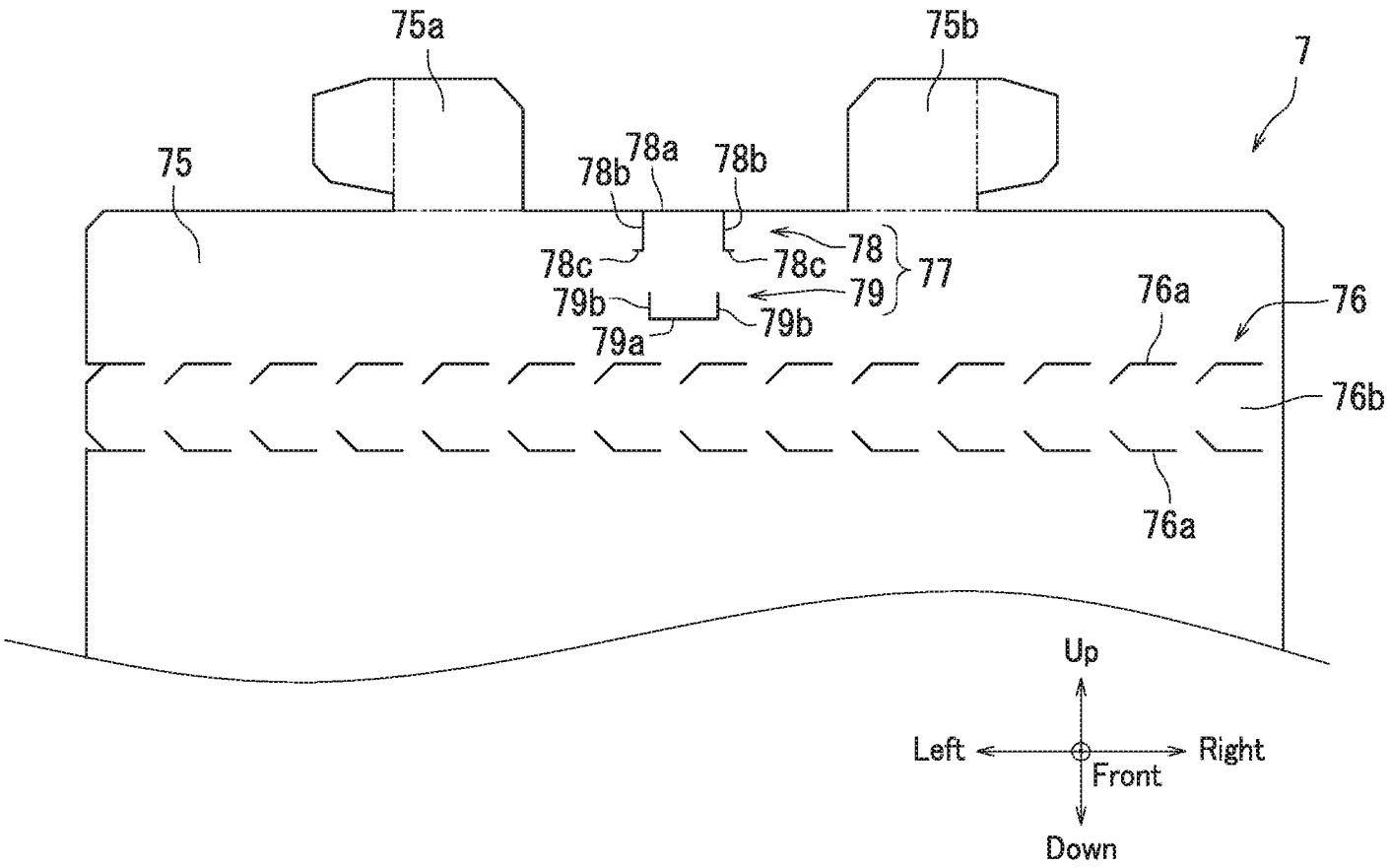
FIG. 3 is an enlarged view illustrating a rear plate cover section illustrated in FIG. 2.

FIG. 3 is an enlarged view illustrating the rear plate cover section 75 illustrated in FIG. 2. As illustrated in FIG. 3, the cover section 7 according to the present embodiment further has a packing opening section 76 and a cut section 77. The packing opening section 76 has a pair of perforated lines 76*a* and a cut-out section 76*b*. The perforated lines 76*a* are formed in the rear plate cover section 75. The perforated lines 76*a* are formed by making series of cuts along the left-right direction. The perforated lines 76*a* extend from a left edge to a right edge of the rear plate cover section 75. The perforated lines 76*a* are located in a central section of the rear plate cover section 75 in terms of the up-down direction (short direction). The cut-out section 76*b* is formed between the perforated lines 76*a* as a result of formation of the perforated lines 76*a*. That is, the cut-out section 76*b* is located between the pair of perforated lines 76*a*.

The cut section 77 according to the present embodiment is formed in the rear plate cover section 75. The cut section 77 is formed at a position where the label 9 illustrated in FIG. 1 is adhered. The cut section 77 is for example formed in the distal section (edge section) of the rear plate cover section 75. The cut section 77 is formed at a central section of the rear plate cover section 75 in terms of the left-right direction (longitudinal direction). The cut section 77 is formed by making cuts.

The cut section 77 according to the present embodiment has a first cut element 78 and a second cut element 79. The second cut element 79 is located opposite to the first cut element 78. The first cut element 78 according to the present embodiment is substantially the shape of the letter U opening toward the central section of the rear plate cover section 75 in terms of the short direction. The second cut element 79 according to the present embodiment is substantially in the shape of the letter U opening toward an edge of the distal section of the rear plate cover section 75.

The first cut element 78 has a first sideways element 78*a* and a pair of first endways elements 78*b*. The first sideways element 78*a* according to the present embodiment is a portion of the edge of the distal section of the rear plate cover section 75. The first endways elements 78*b* extend from the first sideways element 78*a* toward the central section of the rear plate cover section 75 in terms of the short direction. The first cut element 78 according to the present embodiment further has a pair of auxiliary elements 78*c*. The auxiliary elements 78*c* extend along the left-right direction from ends of the respective first endways elements 78*b* that are distant from the first sideways element 78*a*.

The second cut element 79 has a second sideways element 79*a* and a pair of second endways elements 79*b*. The second sideways element 79*a* is located between the packing opening section 76 and the first cut element 78. The second sideways element 79*a* is elongated in the left-right direction. That is, the second sideways element 79*a* is elongated in parallel to the edge of the distal section of the rear plate cover section 75. The second endways elements 79*b* extend from respective ends of the second sideways element 79*a* toward the edge of the distal section of the rear plate cover section 75. Alternatively, the second endways elements 79*b* may be connected to the first endways elements 78*b*.

The following describes a method for packing an article with the packing 1. The packing 1 according to the present embodiment is erected by folding the sheet 10. First, the sheet 10 is formed into a cylindrical shape by bonding the adhesion section 8 to the side plate section 3. Next, the side plate bottom sections 62 and 63, the rear plate bottom section 65, and the front plate bottom section 64 are folded in the stated order to form the bottom plate section 6. After the bottom plate section 6 is formed, an article is placed inside the packing 1 that is open at the top face.

Next, the side plate cover sections 72 and 73, the front plate cover section 74, and the rear plate cover section 75 are folded in the stated order to form the cover section 7. For forming the cover section 7, the engagement sections 75*a* and 75*b* of the rear plate cover section 75 are engaged with the openings 74*a* and 74*b* of the front plate cover section 74, Next, as described with reference to in FIG. 1, the label 9 is adhered so as to span across the cover section 7 and the front plate section 4. As the label 9 is adhered, the cut section 77 is covered by the label 9. Thus, the packing 1 is sealed. The packing 1 is opened by cutting out the cut-out section 76*b* of the packing opening section 76 along the perforated lines 76*a*.

Figure 4:
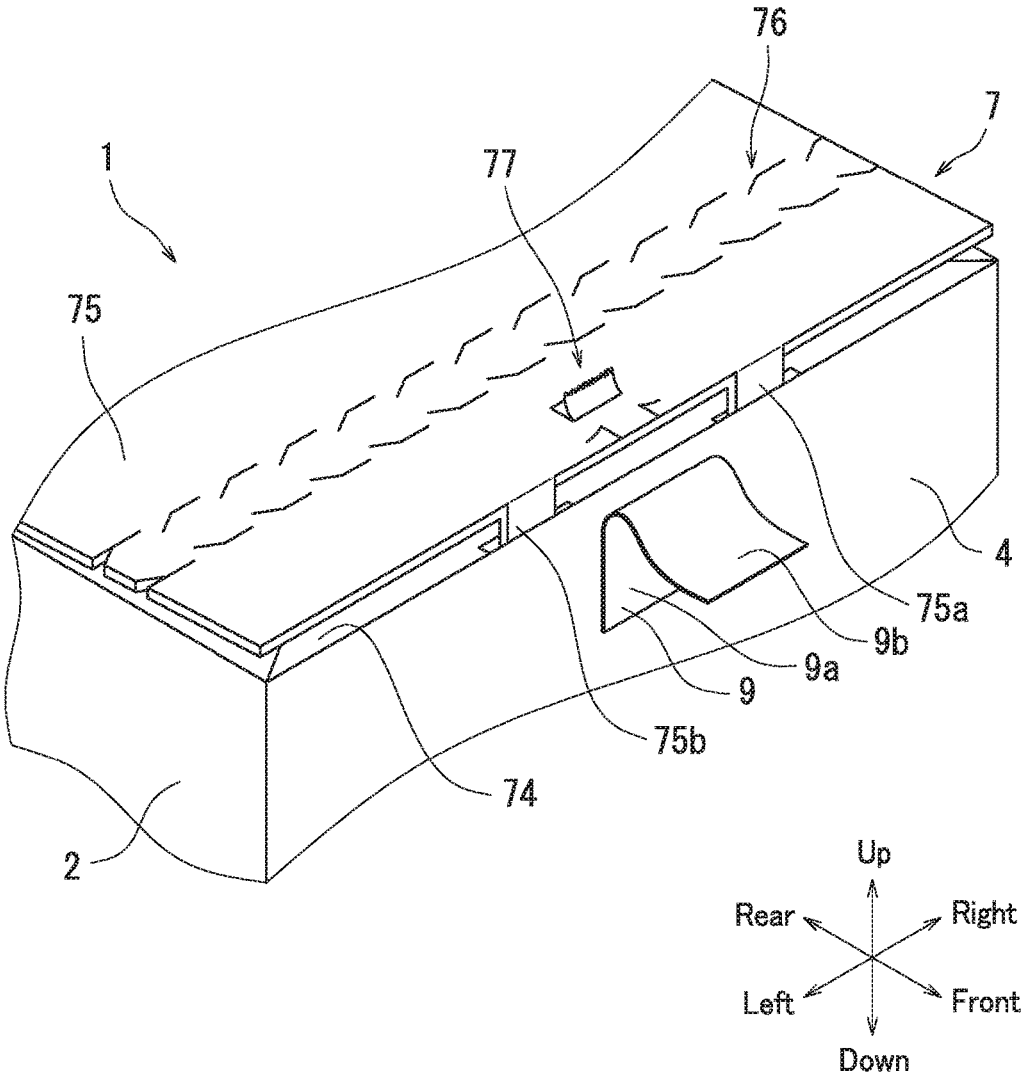
FIG. 4 is a perspective view illustrating the rear plate cover section when the packing is unsealed.

FIG. 4 is a perspective view illustrating the rear plate cover section 75 when the packing 1 is unsealed. The following describes force that acts on the cut section 77 in a situation in which the packing 1 is tampered with by removing the label 9, with reference to FIG. 4. As illustrated in FIG. 4, the label 9 is peeled off the rear plate cover section 75 for tampering with the packing 1. As the label 9 is peeled off, the cut section 77 is pulled by the back part 9*b* of the label 9. Thus, peeling off the label 9 causes damage to the cut section 77.

The label 9 can be removed from the packing 1 by cutting the back part 9*b* with a blade. The back part 9*b* is cut by inserting a blade between the outer part 9*a* and the rear plate cover section 75. Examples of blades that can be used include a paper knife and a box cutter.

For cutting the back part 9*b*, force is applied to the blade. The back part 9*b* is bonded to the cut section 77. Accordingly, the force for cutting the back part 9*b* also acts on the cut section 77. Thus, cutting the back part 9*b* with a blade also causes damage to the cut section 77.

As described above with reference to FIGS. 1 to 4, the cut section 77 of the packing 1 according to the present embodiment is damaged when the label 9 is removed. As a result, the label 9 has a roughened surface in a situation in which a new back part 9*b* is formed using an adhesive, and the label 9 is re-adhered to the packing 1. The roughened surface allows visual confirmation of an evidence of tampering with the packing 1. Thus, the packing 1 according to the present embodiment is difficult to reseal, restricting tampering with the packing 1 and preventing replacement or the like of an article enclosed in the packing 1.

According to the present embodiment, removal of the label 9 starts at an end thereof on the rear plate cover section 75. In a situation in which removal of the label 9 starts at the end thereof on the rear plate cover section 75, the cut section 77 is damaged to be folded in a direction from the central section of the rear plate cover section 75 in terms of the short direction toward a front edge of the rear plate cover section 75. In a situation in which removal of the label 9 starts at an end thereof on the front plate section 4, the cut section 77 is damaged to be folded in a direction from the front edge of the rear plate cover section 75 toward the central section of the rear plate cover section 75 in terms of the short direction.

Through the above, the packing 1 according to the present embodiment has been described with reference to FIGS. 1 to 4. However, the present disclosure is not limited to the above embodiment and may be implemented in various different forms that do not deviate from the essence of the present disclosure.

For example, although the first cut element 78 according to the above-described embodiment of the present disclosure is substantially in the shape of the letter U opening toward the central section of the rear plate cover section 75 in terms of the short direction, the present disclosure is not limited to such an embodiment. The first cut element 78 may be substantially in the shape of the letter U opening toward the edge of the distal section of the rear plate cover section 75. For another example, although the second cut element 79 according to the above-described embodiment of the present disclosure is substantially in the shape of the letter U opening toward the edge of the distal section of the rear plate cover section 75, the present disclosure is not limited to such an embodiment. The second cut element 79 may be substantially in the shape of the letter U opening toward the central section of the rear plate cover section 75 in terms of the short direction.

Figure 5:
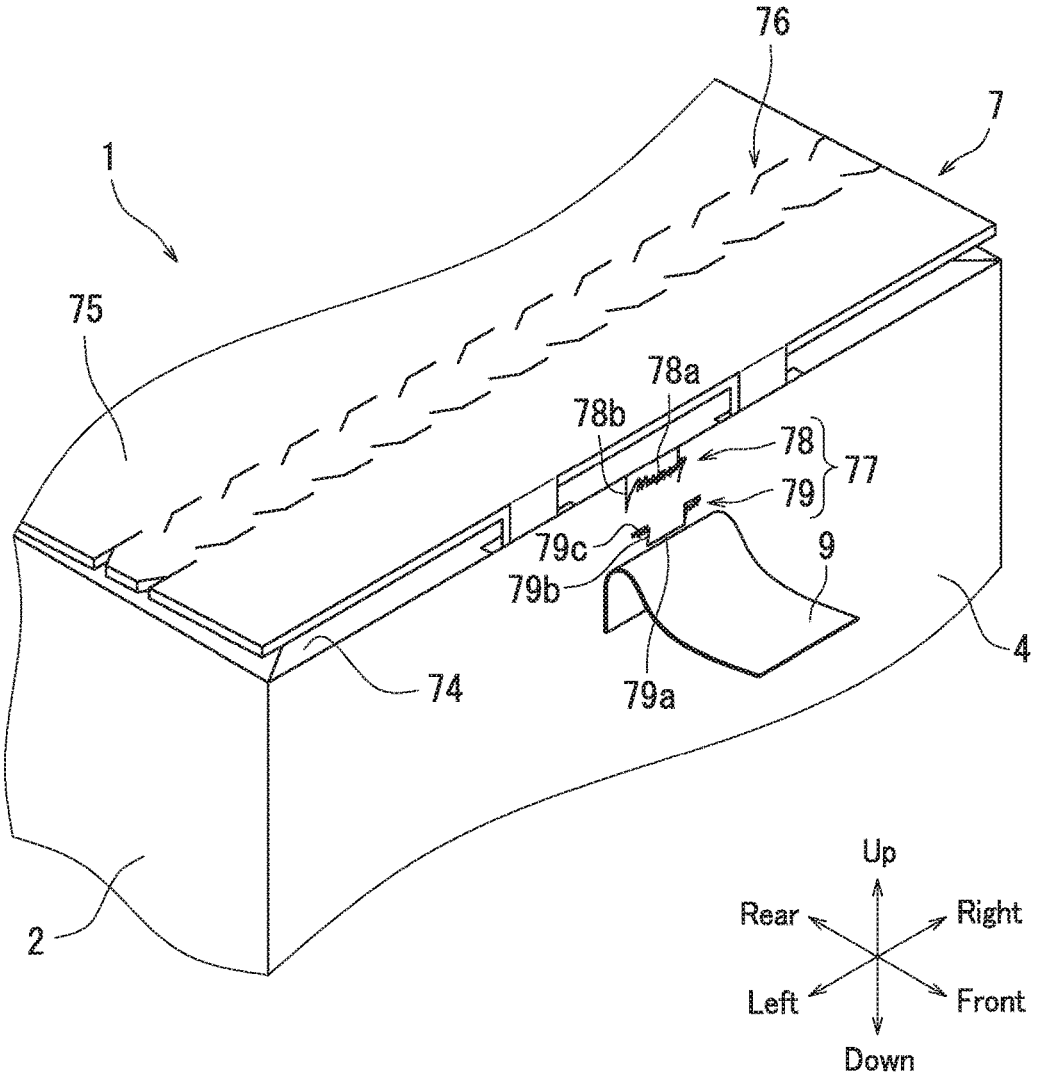
FIG. 5 is a perspective view illustrating a rear plate cover section of packing according to another embodiment of the present disclosure when the packing is unsealed.

For another example, although the cut section 77 according to the above-described embodiment of the present disclosure is formed in the rear plate cover section 75, the present disclosure is not limited to such an embodiment. FIG. 5 is a perspective view illustrating the rear plate cover section 75 of the packing 1 according to another embodiment of the present disclosure. As illustrated in FIG. 5, the cut section 77 may be formed in the front plate section 4.

The cut section 77 illustrated in FIG. 5 is formed in an upper edge section of the front plate section 4. The first cut element 78 of the cut section 77 is substantially in the shape of the letter U opening toward a central section of the front plate section 4 in terms of the up-down direction. The second cut element 79 is substantially in the shape of the letter U opening toward an edge of the upper edge section of the front plate section 4. Alternatively, the first cut element 78 may be substantially in the shape of the letter U opening toward the edge of the upper edge section of the front plate section 4, and the second cut element 79 may be substantially in the shape of the letter U opening toward the central section of the front plate section 4 in terms of the up-down direction.

The first sideways element 78*a* of the first cut element 78 is a portion of the edge of the upper edge section of the front plate section 4. The first endways elements 78*b* extend from the first sideways element 78*a* toward the central section of the front plate section 4 in the up-down direction. The second sideways element 79*a* of the second cut element 79 is formed in the upper edge section of the front plate section 4. The second sideways element 79*a* is elongated in the left-right direction. That is, the second sideways element 79*a* is elongated in parallel to the edge of the upper edge section of the front plate section 4. The second endways elements 79*b* extend from respective ends of the second sideways element 79*a* toward the edge of the upper edge section of the front plate section 4. The second cut element 79 may further have a pair of auxiliary elements 79*c*. The auxiliary elements 79*c* are elongated in the left-right direction.

According to the embodiment illustrated in FIG. 5, removal of the label 9 starts at the end thereof on the rear plate cover section 75. In a situation in which removal of the label 9 starts at the end thereof on the rear plate cover section 75, the cut section 77 is damaged to be folded in a direction from the upper edge section of the front plate section 4 toward the central section of the front plate section 4 in the up-down direction. In a situation in which removal of the label 9 starts at the end thereof on the front plate section 4, the cut section 77 is damaged to be folded in a direction from the central section of the front plate section 4 in the up-down direction toward the upper edge section of the front plate section 4.

The cut section 77 of the packing 1 according to the embodiment illustrated in FIG. 5 is damaged when the label 9 is removed. As a result, the label 9 has a roughened surface in a situation in which a new back part 9*b* is formed using an adhesive, and the label 9 is re-adhered to the packing 1. The roughened surface allows visual confirmation of an evidence of tampering with the packing 1. Thus, the packing 1 is difficult to reseal, restricting tampering with the packing 1 and preventing replacement or the like of an article enclosed in the packing 1.

The cut section 77 may be formed both in the rear plate cover section 75 and in the front plate section 4. A configuration including the cut section 77 both in the rear plate cover section 75 and in the front plate section 4 causes the label 9 to have a widely roughened surface in a situation in which the label 9 is removed and re-adhered to the packing 1. The roughened surface allows more reliable visual confirmation of an evidence of tampering with the packing 1.

For another example, although the cut section 77 according to the above-described embodiment of the present disclosure is substantially in the shape of the letter U, the present disclosure is not limited to such an embodiment. The cut section 77 may have any shape so long as the shape does not reduce strength of the front plate section 4 or the rear plate cover section 75. Desirably, the cut section 77 has a shape that is easily damaged regardless of the end of the label 9 at which removal of the label 9 starts. The cut section 77 may for example have the first endways elements 78*b* each having an arc shape, the second sideways element 79*a* having an arc shape, or the second endways elements 79*b* each having an arc shape.

The drawings schematically illustrate elements of configuration in order to facilitate understanding, and properties of elements of configuration illustrated in the drawings, such as thickness and length, may differ from actual properties thereof in order to facilitate preparation of the drawings. Furthermore, properties of elements of configuration described in the above embodiments, such as material properties and shapes, are merely examples and are not intended as specific limitations. Various alterations may be made so long as there is no substantial deviation from the effects of the present disclosure.

What is claimed is:

1. Packing comprising:

a body section having a first opening;

a cover section configured to close the first opening; and a label configured to be adhered so as to span across the cover section and the body section with the first opening closed by the cover section, wherein at least one of the body section and the cover section has a cut section in an edge section thereof, the cut section is located at a position where the label is adhered so as to be entirely covered with the label, the cut section has:

a first cut element being a cut substantially in a shape of a letter U opening toward a central section of the body section or a central section of the cover section;

a first part surrounded by the first cut element;

a second cut element being a cut substantially in a shape of a letter U opening toward an edge of the body section or an edge of the cover section; and a second part surrounded by the second cut element, the second cut element is located closer toward the central section of the body section or the central section of the cover section than the first cut element, the second cut element is located opposite to the first cut element, the first cut element or the second cut element of the cut section is broken so as to peel off from a surface of the body section or a surface of the cover section when the label is removed, the cover section has a front plate cover section and a rear plate cover section, the front plate cover section has a second opening, the rear plate cover section has an engagement section protruding from an edge of the rear plate cover section, the engagement section has a distal section protruding outward, and for assembling the cover section, the distal section of the engagement section is folded, the engagement section is inserted through the second opening, and the distal section of the engagement section unfolds inside the front plate cover section.

2. The packing according to claim 1, further comprising a packing opening section located in the cover section, wherein the packing opening section includes a pair of perforated lines and a cut-out section located between the pair of perforated lines, and the packing is opened by cutting out the cut-out section along the pair of perforated lines.

3. The packing according to claim 1, wherein the cut section is located in the cover section, in a situation in which removal of the label starts at an end thereof on the cover section, the second cut element of the cut section is broken so as to peel off from the cover section, and in a situation in which removal of the label starts at an end thereof on the body section, the first cut element of the cut section is broken so as to peel off from the cover section.

4. The packing according to claim 3, wherein the first cut element has:

a first sideways element extending along the edge of the cover section;

a pair of first endways elements extending from two respective ends of the first sideways element toward the central section of the cover section; and a pair of auxiliary elements continuous from the respective first endways elements, and each of the auxiliary elements extends along the first sideways element from a distant one of two ends of a corresponding one of the first endways elements, the distant end being distant from the first sideways element.

5. The packing according to claim 1, wherein the cut section is located in the body section, in a situation in which removal of the label starts at an end thereof on the cover section, the first cut element of the cut section is broken so as to peel off from the body section, and in a situation in which removal of the label starts at an end thereof on the body section, the second cut element of the cut section is broken so as to peel off from the body section.

6. The packing according to claim 5, wherein the second cut element has:

a second sideways element extending along the edge of the body section;

a pair of second endways elements extending from two respective ends of the second sideways element toward the edge of the body section; and a pair of auxiliary elements continuous from the respective second endways elements, and each of the auxiliary elements extends along the second sideways element from a distant one of two ends of a corresponding one of the second endways elements, the distant end being distant from the second sideways element.

* * * * *